United States Patent [19]

Albertazzi

[11] 4,128,376

[45] Dec. 5, 1978

[54] PRESSING ARRANGEMENT FOR COMPRESSING CERAMIC AND REFRACTORY MATERIALS INTO TILE PREFORMS

[76] Inventor: Sergio Albertazzi, via Lambruschini 4, Imola-Bologna, Italy

[21] Appl. No.: 841,727

[22] Filed: Oct. 12, 1977

[30] Foreign Application Priority Data

Oct. 28, 1976 [IT] Italy ..... 28787 A/76

[51] Int. Cl.[2] ..... B28B 3/06

[52] U.S. Cl. ..... 425/415; 425/451.2; 425/411; 425/419

[58] Field of Search ..... 425/450.1, 406, 407, 425/410, 411, 412, 415, 419, DIG. 223

[56] References Cited

U.S. PATENT DOCUMENTS

| | | | |
|---|---|---|---|
| 2,075,992 | 4/1937 | Lux et al. | 425/415 |
| 3,375,791 | 4/1968 | Pakula | 425/412 X |
| 3,613,171 | 10/1971 | Hehl | 425/DIG. 223 |
| 3,687,590 | 8/1972 | Cyriax | 425/450.1 X |
| 4,005,974 | 2/1977 | Szabo | 425/DIG. 223 |
| 4,043,730 | 8/1977 | Bettonica | 425/415 X |
| 4,053,276 | 10/1977 | Ahrweiler | 425/406 |

*Primary Examiner*—J. Howard Flint, Jr.
*Attorney, Agent, or Firm*—Michael J. Striker

[57] ABSTRACT

Two mold sections of a mold for compressing a ceramic or refractory material into tile preforms are mounted on respective platens of a pressing machine for displacement toward and away from one another. One of the platens is a part of a frame which further includes upright beams and a support stationarily mounted on the upper ends of the beams. A plurality of cylinder-and-piston units the pistons of which are accommodated in bores of the movable platen and the piston rods of which extend outwardly of the bores and toward the support, is distributed over the movable platen and so acts thereon as to avoid bending of the movable platen. A reaction member is juxtaposed with the support and moves relative thereto between an active position in which the piston rods of the units penetrate into the then coaxial holes of the reaction member to permit the retraction of the movable platen, and an active position in which the piston rods of the units abut against abutment areas of the reaction member so that the units exert desirably distributed forces on the movable platen during the pressing phase of the operation of the pressing arrangement.

11 Claims, 2 Drawing Figures

PRESSING ARRANGEMENT FOR COMPRESSING CERAMIC AND REFRACTORY MATERIALS INTO TILE PREFORMS

BACKGROUND OF THE INVENTION

The present invention relates to a pressing arrangement in general, and more particularly to a pressing arrangement to be used for compressing refractory or ceramic material into tile preforms.

Pressing arrangements of the type here under consideration are already known and some types thereof have already been employed in the production of ceramic or refractory tiles. One of such types of pressing arrangements includes a base from which at least two parallel uprights or beams extend upwardly. A stationary platen forms the base and a stationary support, such as a transverse beam or a similar structure, is mounted on the upper ends of the upright beams. A mold is affixed to the base intermediate the upright beams and has a set of adjacent depressions of square or rectangular cross sections. During the operation of the pressing arrangement, powdery or granulated material is first charged into the depressions by means of a charging conveyor of a conventional construction, then the material in the depressions is compressed by means of, and during the lowering of, a vertically movable horizontally extending transverse beam or a similar structure which is guided on the upright beams and has pressing projections that are directed toward and aligned with the respective depressions. Each of the pressing projections is so positioned as to enter a respective depression of the mold when the movable platen or a similar structure is pressed downwardly by a mechanically or hydraulically operated arrangement, in order for the pressing projections to compress the material contained in the depressions of the mold.

In many presses of this type which have been built recently, the pressing arrangement, which may be constituted by a hydraulic cylinder-and-piston unit or a threaded spindle rotated by a flywheel, is separate and independent from the arrangement which vertically displaces the movable platen during its approach and withdrawal from the final pressing position so that the pressing arrangement is employed only for transmitting such controlled and successive forces to the movable platen which are necessary for the actual compression of the material in the mold. Usually, each pressing operation includes a first stage of light pressing action during which the force or forces exerted on the movable platen is or are limited to the value needed for expelling air inclusions from the material to thereby reduce the thickness of the material in the respective depression of the mold to almost its final value. In other words, the pressing projections perform the greater part of their pressing stroke during such first stage, thus substantially compacting the material. Thereafter, the movable platen is subjected, during a second stage, to a stronger pressing action so that the pressing projections harden and compact the material in the respective dies into the shape of tile preforms or the like.

In such conventional presses, the pressing arrangement exerts a bias on the movable platen which is concentrated in the region of an axis of symmetry of the movable platen which extends in the direction of movement of the latter. The mold opposes such an applied bias by reaction forces which are substantially spaced from such a vertical axis so that the reaction forces cause the movable platen to elastically deform or deflect. As a consequence of this, the pressure of the respective pressing projections on the material in the respective depressions gradually decreases from the center to the periphery of the mold. These different pressures result in different degrees of compaction of the material, not only from die to die, but also from the side more distant from, to the side nearer to, the symmetry axis, within the same depression.

These differences in the degree of compaction of the material cause disadvantgeous results, especially after the tile preforms have been baked in order to obtain the tiles, inasmuch as such tiles not only have a different color from one side to the opposite one, but also have a different porosity and a different shrinkage ratio at various regions thereof so that the tiles become slightly trapezoidal in shape instead of square or rectangular, during the baking operation.

In an attempt to eliminate such negative effects, it has been heretofore proposed to make the movable platen of sizable dimensions, and particularly of a considerable cross section. When this approach is taken, the movable platen has a considerable weight. Furthermore, to limit the degree of flexion, at least that dimension of the movable platen which extends between the beams is reduced which has the advantageous effect of reducing the degree of bending of the movable platen, but also the disadvantageous effect of reducing the distance at which the beams can be located from one another. However, even this approach is not entirely successful because it only reduces but does not eliminate the flexion of the movable platen, and additionally increases the weight of the movable platen which, in turn, calls for the employment of more powerful means for displacing and biasing the movable platform. An additional drawback of this conventional type of pressing arrangement resides in the fact that the output thereof is quite small, which is attributable to the reduction of the space between the uprights available for accommodating the mold with the depression therein. To give an example, when a press of this type is used for manufacturing square tile preforms having dimensions 15 × 15 cm, the maximum numbers of depressions which can be provided in the mold is five. Of course, when the tiles or tile preforms to be formed in the conventional press of this type have to have larger dimensions, the number of tiles or tile preforms which can be manufactured during one complete pressing cycle is further reduced, such as to two, thus further drastically reducing the output rate of the pressing arrangement.

SUMMARY OF THE INVENTION

Accordingly, it is a general object of the present invention to avoid the disadvantages of the prior art.

More particularly, it is an object of the present invention to so design a pressing arrangement, particularly for compressing ceramic or refractory materials into tile preforms or the like, as not to be possessed of the disadvantages of the prior-art pressing arrangement of this type.

A further object of the present invention is to so construct the platens of the pressing arrangement that the material confined between mold sections respectively mounted on the platens is subjected to uniformly distributed forces during the compression thereof into a preform.

A concomitant object of the present invention is to develop a pressing arrangement of the above-mentioned type which is simple in construction, inexpensive to manufacture but reliable in operation nevertheless.

In pursuance of these objects and others which will become apparent hereafter, one feature of the present invention resides, briefly stated, in a pressing arrangement, particularly for compressing ceramic and refractory materials into tile preforms, which comprises a frame including a stationary platen, a stationary support and a plurality of elongated beams extending between said stationary platen and said support; a movable platen mounted on said beams for displacement longitudinally of the latter between a retracted position and a final pressing position; means for displacing said movable platen between said positions thereof; a mold having two mold sections one mounted on said stationary platen and the other on said movable platen for joint displacement therewith in registry with said one mold section, said mold being open in said retracted position of said movable platen to permit at least the withdrawal of the preforms from said mold, and said mold sections compressing the materials in said mold as said movable platen approaches said final pressing position; and means for subjecting said mold to pressing forces, including a plurality of cylinder-and-piston units separate from said displacing means and distributed over said movable platen to exert distributed pressing forces thereon and to uniformly press the same toward said final pressing position. In an advantageous embodiment of the present invention, the beams have upright orientations and the stationary platen is located at the lower ends and the support at the upper ends of the beams. Then, the above-mentioned one mold section has at least one upwardly open depression permitting the introduction of the material thereinto in the retracted position of said movable platen, and the other mold section includes at least one pressing projection penetrating into the depression during the displacement of said movable platen toward said final pressing position. As currently preferred, the one mold section has a plurality of additional depressions similar to the above-mentioned depression and arranged in an array therewith. Then, the other mold section includes a plurality of additional pressing projections similar to the pressing projection mentioned above and each aligned with one of the additional depressions.

The distribution of the biasing forces over the movable platen eliminates the tendency of the movable platen to elastically bend upwardly towards its ends. Consequently, a movable platen may be used which has a lesser weight and thus requires a reduced power to the above-mentioned displacement means. Moreover, a longer movable platen may be used, rendering it possible to employ molds having a greater number of depressions, thus increasing the output of the press per operating cycle as compared to that of the conventional presses of this type.

In a currently preferred embodiment of the present invention, the displacing means includes at least one hydraulically operated displacing device, such as a cylinder-and-piston unit. Under these circumstances, both the displacing means and the above-mentioned cylinder-and-piston units constituting the subjecting means, can be supplied with an operating fluid, such as oil or other hydraulic fluid, from a common source.

Advantageously, all of the units have the same active areas adapted to be exposed to the action of the operating fluid. As mentioned above, the pressing operation may be conducted in two stages. Then, the units of the subjecting means may be arranged in two sets one of which is energized during both stages and exerting basic forces on the movable platen and the other of which is energized only during a later one of the stages to exert additional forces on the movable platen. The possibility of selecting the energization of the cylinder-and-piston units of the subjecting means renders it possible to use a reduced number of the units during the light pressing action, that is, precompression or first pressing action, and to use all of the units for the subsequent pressing action or actions.

As an alternative, each of the units may have two of the above-mentioned areas one of which is free of the action of the operating fluid during an earlier one of said stages so that said units exert lower forces on said movable platen during such earlier stage than during a later stage. The units of the subjecting means are so distributed as to effectively counteract the tendency of the movable platen to bend during the pressing operation.

According to a currently preferred concept of the present invention, each of the units of the subjecting means includes a bore in the movable platen, a piston accommodated in the bore, and a piston rod emerging from the bore toward the above-mentioned support. Advantageously, reaction means is juxtaposed with the support, and the piston rods of the units abut against predetermined areas of the reaction means when the movable platen approaches the final pressing position and the units are energized. Such reaction means advantageously includes at least one reaction member which is mounted on the support for movment transversely of the beams between an inactive position and an active position in which the piston rods of the units register with the predetermined areas of the reaction member, the latter having a plurality of holes which are each coaxial with one of the piston rods in the inactive position thereof and which permit the introduction of the piston rods thereinto as the movable platen is displaced toward the retracted position thereof.

The above-discussed expedient of providing the reaction member formed with the holes greatly reduces the stroke which the pistons of the hydraulic units have to perform and, consequently, limits the amount of oil or other hydraulic fluid employed, and the power consumed, by the hydraulic equipment.

Another facet of the present invention resides in means for reciprocating the reaction member between the positions thereof, including at least one actuating cylinder-and-piston unit. Advantageously, the actuating unit acts on one side of the reaction member transversely of the beams, and the reciprocating means includes an additional actuating unit which is similar to the actuating unit and acts on an opposite side of the reaction member. When this is done, the above-mentioned source may also supply the necessary operating fluid to these actuating units.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
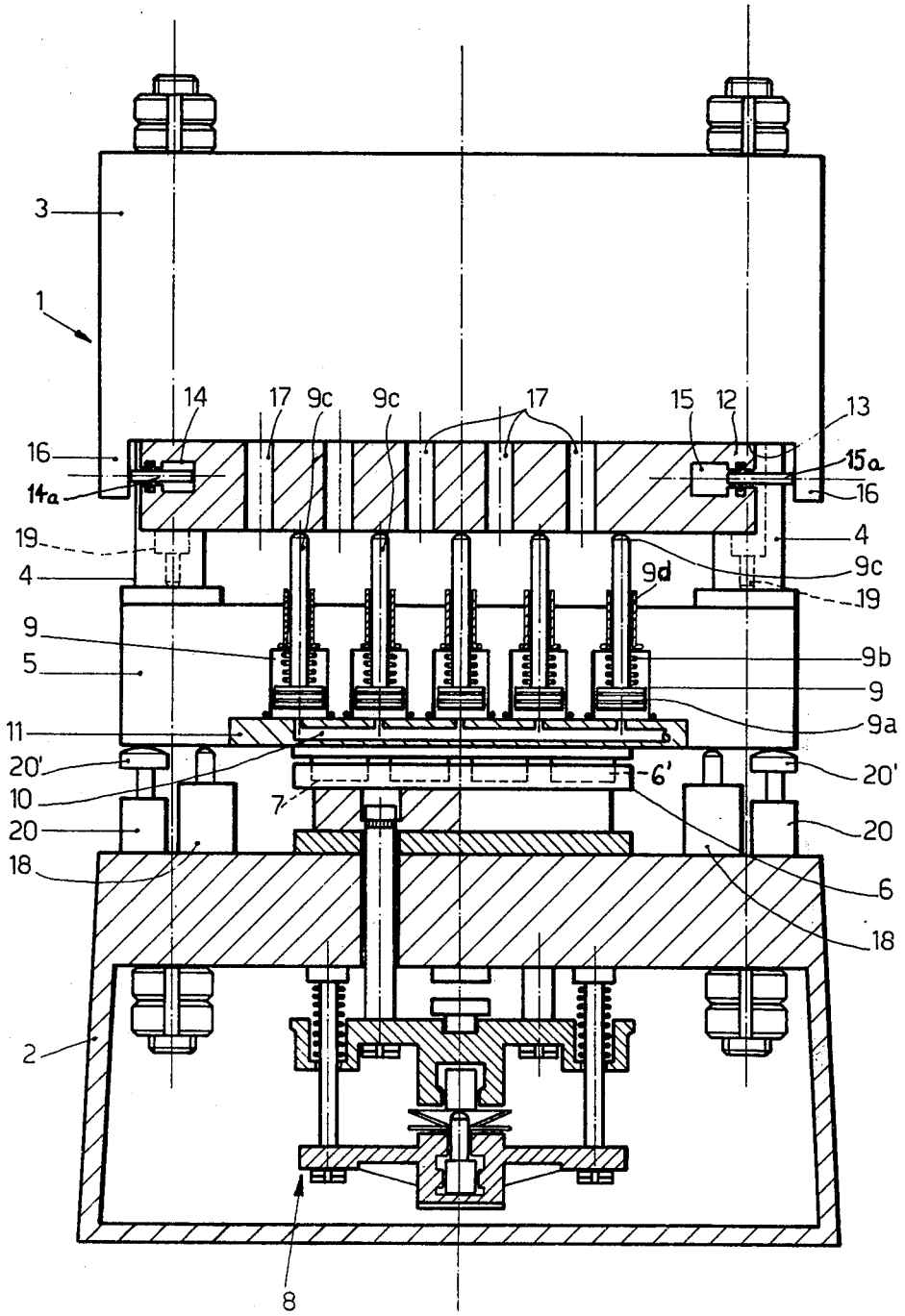
FIG. 1 is a somewhat diagrammatic partly sectioned side elevational view of a press employing the present invention in a pressing position thereof.

Referring now to the drawings, it may be seen therein that the reference numeral 1 has been used to indicate a frame or a similar structure of a press in toto. The frame 1 consists of a base or a stationary platen 2, a stationary upper support 3, and two parallel vertical upright beams 4 extending upwardly from the stationary platen 2, the stationary support 3 being affixed to the upper ends of the upright beams 4.

The upright beams 4 are located at a distance that determines the length of a mold 6 which is supported on the stationary platen 2. The mold 6 is provided with an array of depressions 6' which are to be charged with the material to be pressed at the commencement of each operating cycle of the press. The material in the depressions 6' is then subjected to the pressing action of plungers or other pressing projections 7 carried by a horizontally extending movable platen 5 guided on the upright beams 4 for a vertical displacement. The movable platen 5 is displaceable from an upper retracted position illustrated in FIG. 2 in which the depressions 6' of the mold 6 can be charged with the material, to a lower pressing position shown in FIG. 1 in which the pressing projections 7 act on the material present in the depressions 6' to compress such material into ceramic or refractory tile preforms accommodated in the respective depressions 6' of the mold 6. The preforms can then be removed from the depressions 6' when the movable platen 5 assumes its retracted position and thus renders the depressions 6' accessible.

The operating cycle of such a press is very similar to that of the conventional presses so that it requires no detailed additional discussion here beyond what has already been mentioned above. Also, the mold 6 which is used in the environment of the present invention is of a conventional construction and thus need not be discussed herein in detail. However, it is to be mentioned that, as illustrated particularly in FIG. 1, the depressions 6' can be delimited at the bottom regions thereof by movable walls acted upon by a double-acting hydraulic mechanism 8 which, in a conventional manner, assists the removal of the preforms from the respective depressions 6'.

According to the present invention, the movable platen 5 incorporates a plurality of single-acting, for instance hydraulic, cylinder-and-piston units 9, all having their axes perpendicular to the movable platen 5 and distributed at regular spacing in one or more rows, or otherwise distributed in a manner best suited for counteracting the flexion of the movable platen 5.

In the embodiment illustrated in the drawings, there are provided five of the units 9, but the number of such units 9 may be varied in dependence on the useful length of the movable platen 5, on the power of the press, and on the total pressing force that is to be applied to the movable platen 5. Moreover, the units 9 may have different sizes when it is desired to apply different individual forces over the movable platen 5, in proportion to the reaction forces exerted by the mold 6 on the movable platen 5.

Each unit 9 includes a bore in the movable platen 5, a piston **9*a* mounted in the respective bore for reciprocation, a helical spring 9*b* also accommodated in the respective bore and abutting against the piston 9*a* at one of its ends and against the movable platen 5 on its other end, and a piston rod 9*c* extending upwardly and out of the respective bore and beyond the movable platen 5. A vertically oriented sleeve 9*d* guides the piston rod 9*c*** during the reciprocation thereof.

All of the hydraulic units 9 may be simultaneously supplied with a hydraulic fluid by means of a manifold 10 formed in a distributing plate 11 affixed to the movable platen 5 at the lower face thereof. Under these circumstances, the hydraulic fluid is delivered into the manifold 10 from a hydraulic pump or a similar device which is capable of delivering the hydraulic fluid at different pressures. Thus, when the pressing operation is to be accomplished in two stages, the hydraulic fluid is at a lower pressure during the earlier stage during which the material in the depressions 6' of the mold 6 is precompressed, and the pressure of the hydraulic fluid is subsequently raised for performing the second stage during which the material is hardened and compacted into the final tile preforms of ceramic or refractory material. A hydraulic equipment which is capable of this diversified operation is also already well known and needs no discussion herein.

As an alternative to the above-discussed procedure, to be used particularly when only a constant-pressure hydraulic supply is available or when it is desired to use one and the same pressure during the entire operating cycle, the hydraulic units 9 may be so supplied with the hydraulic fluid from the constant-pressure source that only some of the units 9 are energized during the earlier stage, while all of the units are energized during the later stage. Advantageously, the units 9 which are energized during the earlier stage are arranged symmetrically with respect to the central vertically extending axis of the movable platen 5 so as to subject the same to uniform loading. However, it is also possible to provide each of the pistons **9*a* with two different active areas to one of which the hydraulic fluid is not delivered during the earlier stage of the operation of the units 9. Thus, here again, different forces are exerted by the units 9** during the earlier and the later stage of operation thereof.

A transversely extending reaction member 12 is arranged upwardly of the movable platen 5, extending parallel to the movable platen 5 and resting against the lower face of the stationary support 3. The reaction member 12 is mounted on the support 3 by means of non-illustrated conventional guiding members which guide the reaction member 12 for reciprocation between an active position illustrated in FIG. 1 and an inactive position illustrated in FIG. 2.

The reciprocation of the reaction member 12 is achieved by resorting to the use of two actuating units 14 and 15 which are arranged at the opposite ends of the reaction member 12, the hydraulic actuating units 14, 15 being coaxial and including plungers **14*a*, 15*a* which extend beyond the respective ends of the reaction member 12**.

The projecting ends of the plungers **14*a* and 14*b* abut against abutments 16 rigid with the stationary support 3 so that, when hydraulic operating fluid is supplied to the respective actuating units 14 or 15, the respective plunger 14***a*, or 14*b* is displaced beyond the respective end of the reaction member 12, thus causing the latter to be displaced from its active into its inactive position or vice versa.

The reaction member 12 is provided with a plurality of holes 17 which are oriented and spaced from each other in the same way as the piston rods 9*c* of the hydraulic units 9 so that, when the reaction member 12 assumes its inactive position, the longitudinal axis of the piston rods 9*c* and of the holes 17 coincide. Under these circumstances, which occur at the end of a respective pressing cycle, that is upon the discontinuance of the action of the hydraulic fluid on the piston 9*a* and their partial retraction due to the action of the springs 9*b*, and subsequent to the activation of the actuating unit 14, whereby the reaction member 12 assumes the inactive position thereof illustrated in FIG. 12, the piston rods 9*c* of the units 9 can be introduced into the holes 17 of the reaction member 12 so that the movable platen 5 can be raised into its retracted position illustrated in FIG. 2. The length of the holes 17 is such that it allows the raising of the movable platen 5 not only to the extent necessary for charging the material into the mold 6 subsequent to the removal of the already compressed preforms therefrom, but also to a larger extent when it is desired to gain access to the mold 6 and to the depressions 6' thereof, for instance, for cleaning purposes.

Figure 2:
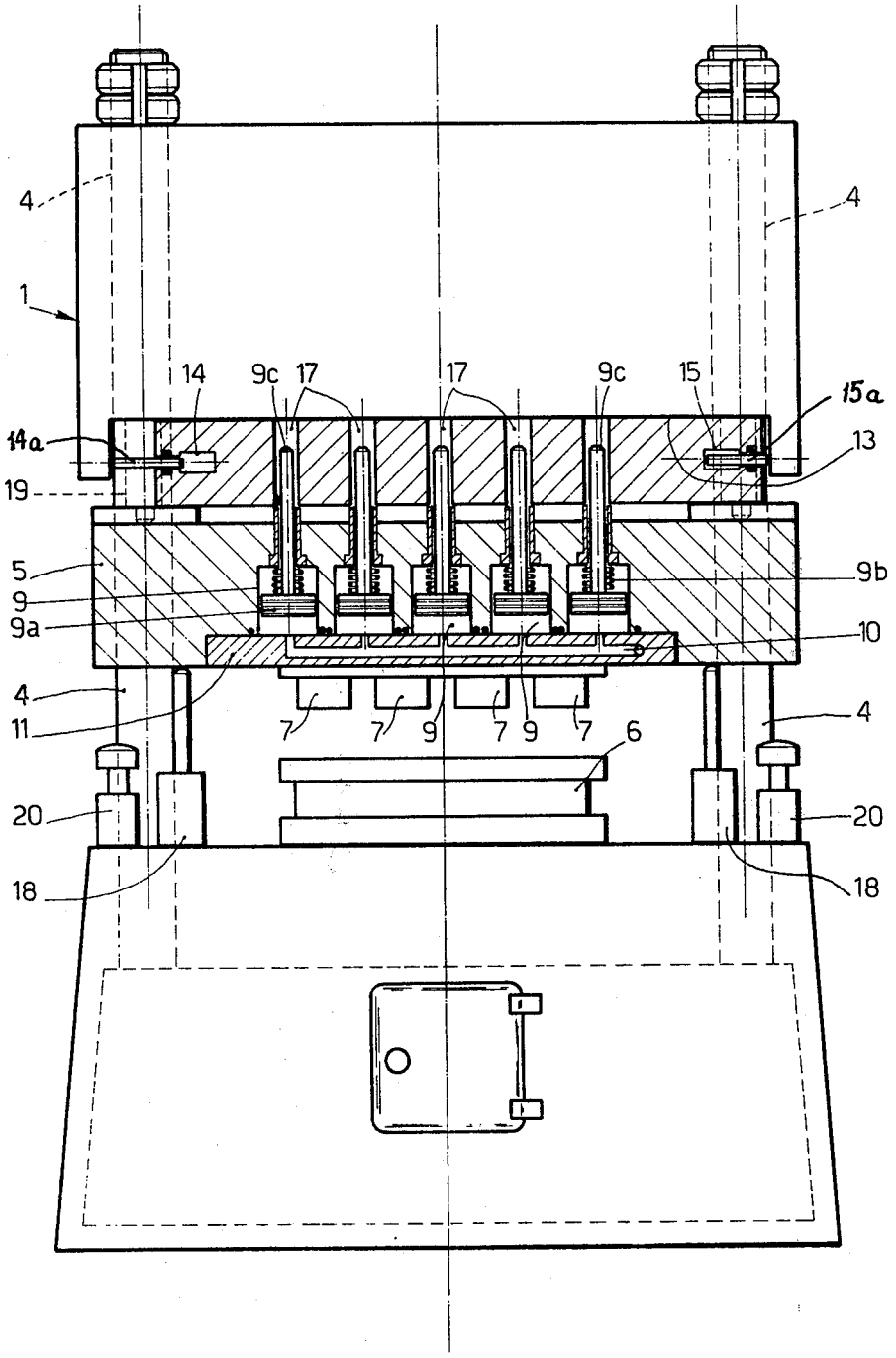
FIG. 2 is a partial view similar to that of FIG. 1 but in a retracted position.

On the other hand, when the movable platen 5 is lowered into the position illustrated in FIG. 1, preparatory to the performance of the actual pressing operation, the reaction member 12 is displaced in the opposite direction so that the ends of the piston rods 9*c*, which are already in close proximity of the reaction member 12, abut against abutment regions of the reaction member 12 in between the holes 17 when energized by the hydraulic fluid so that the piston rods 9*c* will appear against the abutment portions of the reaction member 12 and thus subject the movable platen 5 to downwardly oriented forces which are transmitted to the pressing projections 7 for the latter to compress and/or harden the material present in the depressions 6' of the mold 6.

It will be appreciated when considering FIG. 1 that the hydraulic units 9 subject the movable platen 5 to a plurality of forces which are distributed over the area of the movable platen 5, such forces directly opposing the reaction forces exerted on the movable platen 5 by the mold 6 and the pressing projections 7. In this manner, the tendency of the movable platen 5 to deform, which is otherwise present when only a single centrally located force is applied to the movable platen 5 for moving the same downwardly, is eliminated. As will also become apparent from the consideration of the drawings, the hydraulic units 9 are not being used for displacing the movable platen 5 towards its pressing position and back to its retracted position. Rather, the units 9 are only used for subjecting the movable platen 5 to the above-mentioned downwardly oriented forces when the movable platen 5 is already in its pressing position. This renders it possible to so construct the units 9 that the pistons 9*a* and the piston rods 9*b* thereof only perform short strokes during the energization thereof, the magnitude of such strokes being determined by the degree of compaction of the material present in the depressions 6' of the mold 6, that is, by the extent to which the thickness of the layer of the material present in the depressions 6' of the mold 6 is to be reduced during the pressing operation proper. So, for instance, the piston 9*a* need be displaced only by several millimeters during the above-mentioned earlier stage of operation, and to even less extend during the subsequent pressing stage or stages. Provided that the cylinders of the hydraulic units 9 are, at all times, filled with the hydraulic operating fluid, this expedient reduces the amount of the hydraulic operating fluid which has to be supplied to and withdrawn from the units 9, on the one hand, and permits to rapidly bring the pressure in the cylinders of the units 9 up or down as desired.

The above-mentioned rapid or sudden variation of the pressure prevailing in the cylinder chamber is very important, particularly during the above-mentioned subsequent pressing stage, in order to be able to obtain a sufficient hardening of the material of the tile preforms. Additionally, the hydraulic equipment which is needed for performing the above-discussed pressing stroke needs only have a limited power.

The displacements of the movable platen 5 are accomplished by displacing means which is separate and independent from the hydraulic units 9 but which is operated in a predetermined sequence with reference to the operation of the units 9, and also of the actuating units 14 and 15. Such displacing means which is capable of displacing the movable platen 5 between its retracted and pressing position includes a pair of hydraulic cylinder-and-piston units 18, each arranged at a respective side of the press. The hydraulic displacing units 18 are energized when the movable platen 5 is to be raised, while the pressure prevailing therein is relieved through non-illustrated conventional adjustable throttling means when it is desired to lower the movable platen 5. The adjustable throttling means is operative for retarding the descent of the movable platen 5 due to gravity whenever such retardation is necessary, especially to avoid problems arising in connection with expressing included air from the material in the depressions 6' of the mold 6.

In some instances, however, the gravity descent of the movable platen 5 is insufficient, so that the drawing further illustrates, in dashed lines, a pair of hydraulic displacing units 9 which are mounted on the stationary support 3 and act on the movable platen 5 in opposition to the retarding action of the hydraulic units 18. Thus, the hydraulic displacing units 19 are utilized to accelerate the descent of the movable platen 5 and also eliminates the problems which could otherwise arise if gravity descent of the movable platen 5 has to be relied on.

In addition thereto, as also illustrated in the drawing, there are provided two hydraulic units 20, each arranged next to a respective hydraulic unit 18 and also of a conventional construction. The hydraulic units 20 have height-adjustable heads 20' at the ends of the piston rods. The hydraulic units 20 are constantly maintained under pressure and communicate with respective non-illustrated conventional damping arrangements, the units 20 thus constituting elastic members when the movable platen 5 abuts against the head 20' thereof during the descent thereof.

The function of the hydraulic units 20 is to urge the movable platen 5 upwardly, particularly for lifting the movable platen 5 slightly between the two abovementioned pressing stages, that is, after the pressing projections 7 have been introduced into the depressions 6' of the mold 6 to a predetermined extent, to control the deaeration of the material present in the depressions 6' of the mold 6 in the interval between the earlier pressing stage and the later pressing stage.

It will be understood that each of the elements described above, or two or more together, may also find a useful application in other types of construction differing from the types described above.

While the invention has been illustrated and described as embodied in a pressing arrangement for manufacturing tile preforms, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A pressing arrangement, particularly for compressing ceramic and refractory materials into tile preforms, comprising a frame including a stationary platen, a stationary support and a plurality of elongated beams extending between said stationary platen and said support; a movable platen mounted on said beams for displacement longitudinally of the latter between a retracted position and a final pressing position; means for displacing said movable platen between said positions thereof; a mold having two mold sections one mounted on said stationary platen and the other on said movable platen for joint displacement therewith in registry with said one mold section, said mold being open in said retracted position of said movable platen to permit at least the withdrawal of the preforms from said mold, and said mold sections compressing the materials in said mold as said movable platen approaches said final pressing position; and means for subjecting said mold to pressing forces, including a plurality of cylinder-and-piston units separate from said displacing means and distributed over said movable platen to exert distributed pressing forces thereon and to uniformly press the same toward said final pressing position each of said units including a bore in said movable platen, a piston accommodated in said bore, and a piston rod emerging from said bore toward said support; and further comprising reaction means juxtaposed with said support, and wherein said piston rods of said units abuts against predetermined areas of said reaction means when said movable platen approaches said final pressing position and said units are energized.

2. A pressing arrangement as defined in claim 1, wherein said beams have upright orientations, said stationary platen being located at the lower, and said support at the upper, ends thereof; wherein said one mold section has at least one upwardly open depression permitting the introduction of the materials thereinto in said retracted position of said movable platen; and wherein said other mold section includes at least one pressing projection penetrating into said depression during the displacement of said movable platen toward said final pressing position.

3. A pressing arrangement as defined in claim 2, wherein said one mold section has a plurality of additional depressions similar to said depression and arranged in an array therewith; and wherein said other mold section includes a plurality of additional pressing projections similar to said pressing projection and each aligned with one of said additional depressions.

4. A pressing arrangement as defined in claim 1, wherein said displacing means includes at least one hydraulically operated displacing device.

5. A pressing arrangement as defined in claim 1, wherein said units all have the same active areas adapted to be exposed to the action of an operating fluid.

6. A pressing arrangement as defined in claim 5; wherein the pressing operation is conducted in two stages; and wherein said units are arranged in two sets one energized during both stages and exerting basic forces on said movable platen and the other energized only during a later one of said stages to exert additional forces on said movable platen.

7. A pressing arrangement as defined in claim 5, wherein the pressing operation is conducted in two stages; and wherein each of said units has two of said areas one of which is free of the action of the operating fluid during an earlier one of said stages so that said units exert lower forces on said movable platen during such earlier stage than during a later stage.

8. A pressing arrangement as defined in claim 1, wherein said units are so distributed as to effectively counteract the tendency of said movable platen to bend during the pressing operation.

9. A pressing arrangement as defined in claim 1; wherein said reaction means includes at least one reaction member mounted on said support for movement transversely of said beams between an inactive position and an active position in which said piston rods of said units register with said predetermined areas and having a plurality of holes each coaxial with one of said piston rods in said inactive position thereof and permitting the introduction of said piston rods thereinto as said movable platen is displaced toward said retracted position thereof.

10. A pressing arrangement as defined in claim 9; and further comprising means for reciprocating said reaction member between said positions thereof, including at least one actuating cylinder-and-piston unit.

11. A pressing arrangement as defined in claim 10, wherein said actuating unit acts on one side of said reaction member transversely of said beams; and wherein said reciprocating means includes an additional actuating unit similar to said actuating unit and acting on an opposite side of said reaction member.

* * * * *